US007493867B2

(12) United States Patent
Asano

(10) Patent No.: US 7,493,867 B2
(45) Date of Patent: Feb. 24, 2009

(54) SEWING MACHINE

(75) Inventor: Yukinobu Asano, Chofu (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 11/525,271

(22) Filed: Sep. 22, 2006

(65) Prior Publication Data

US 2007/0144418 A1 Jun. 28, 2007

(30) Foreign Application Priority Data

Sep. 22, 2005 (JP) ..... 2005-276152

(51) Int. Cl.
*D05B 19/00* (2006.01)

(52) U.S. Cl. ..... 112/470.04; 112/470.01; 700/138

(58) Field of Classification Search ..... 112/78, 112/102.5, 470.01, 470.04; 700/130, 131, 700/136, 137, 138
See application file for complete search history.

(56) References Cited

U.S. PATENT DOCUMENTS 4,622,907 A * 11/1986 Kimura ..... 112/102.5
4,742,786 A * 5/1988 Hashimoto et al. ..... 112/102.5
4,998,489 A * 3/1991 Hisatake et al. ..... 112/103
5,005,500 A * 4/1991 Kato et al. ..... 112/102.5
5,357,442 A * 10/1994 Sekine ..... 700/137
5,506,942 A * 4/1996 Mikuni et al. ..... 358/1.11
5,769,013 A * 6/1998 Morita ..... 112/102.5
5,775,240 A * 7/1998 Hara et al. ..... 112/102.5
5,782,189 A * 7/1998 Hirata et al. ..... 112/102.5
6,321,671 B1 * 11/2001 Tomita ..... 112/475.19
2007/0129840 A1 * 6/2007 Nobuyuki et al. ..... 700/138

FOREIGN PATENT DOCUMENTS

JP 58-198371 11/1983
JP 6-310276 11/1994
JP 6-343778 12/1994
JP 7-255970 10/1995
JP 7-265567 10/1995
JP 3505738 12/2003

* cited by examiner

*Primary Examiner*—Gary L Welch
*Assistant Examiner*—Nathan E Durham
(74) *Attorney, Agent, or Firm*—Merchant & Gould P.C.

(57) ABSTRACT

A continuous line is set on a display region of an operation panel provided in a sewing machine M and a plurality of sewing patterns is automatically arranged along the continuous line based on sewing data selected from a ROM. Integrated sewing data related to a continuous sewing pattern including the sewing patterns is created, an operation of the sewing machine is controlled based on the integrated sewing data so that the continuous sewing pattern can be sewn onto a cloth.

7 Claims, 13 Drawing Sheets

SEWING MACHINE

The present invention claims foreign priority from Japanese patent application no. 2005-276152, filed on Sep. 22, 2005, the content of which is incorporated herein by reference.

BACKGROUND OF THE INVENTION

1. Field of the Invention

The present invention relates to a sewing machine in which a pattern arrangement is set.

2. Description of the Related Art

In a household sewing machine, various sewing patterns are sewn onto a cloth by driving an embroidery frame (a holding frame) with the cloth set thereon in X-Y directions in accordance with sewing pattern data.

For example, a household sewing machine described in JP-A-6-343778 can perform embroidery at a desired position on a cloth by setting an arrangement of a sewing pattern. The arrangement of the sewing pattern is set by optionally setting a sewing position of the sewing pattern with respect to a sewing allowable area within an embroidery frame on a display portion of the sewing machine.

In a recent household sewing machine, imitative stitchings having a complicated arrangement are demanded. For example, there are demands of a stitching in which a plurality of sewing patterns of one type is arranged continuously along a circular arc line or a straight line, and a stitching in which sizes of sewing patterns are sequentially enlarged or reduced.

However, in order to achieve such a complicated pattern arrangement in the sewing machine disclosed in JP-A-6-343778, for example, it is necessary to carry out a setting work such as setting the sewing pattern to a desirable arrangement position and changing a pattern size and an angle for each of a large number of sewing patterns. Therefore, there is a problem in that the setting work is complicated.

SUMMARY OF THE INVENTION

It is an object of the invention to provide a sewing machine capable of easily carrying out a setting work for continuously arranging a plurality of sewing patterns along a predetermined line so as to have a predetermined arrangement.

According to a first aspect of the invention, a sewing machine includes: a needle which moves in a vertical direction; a cloth holding portion which holds a workpiece and moves in a direction orthogonal to the vertical direction; a storage section which stores sewing data corresponding to a plurality of kinds of sewing patterns; a display section having a display region corresponding to a sewing region of the cloth holding portion; a continuous line setting section which sets an arbitrary line on the display region of the display section; a selecting section which selects desirable sewing data from the sewing data stored in the storage section; a pattern arranging section which automatically arranges a plurality of sewing patterns corresponding to the sewing data selected by the selecting section along the line set by the continuous line setting section and displays the plurality of sewing patterns on the display region; a sewing data creating section which creates integrated sewing data on the plurality of sewing patterns arranged by the pattern arranging section; and a cloth holding portion moving section which moves the cloth holding portion in order to form the plurality of sewing patterns on the workpiece held by the cloth holding portion based on the integrated sewing data.

According to the first aspect of the invention, a sewing machine can set the arbitrary line (a continuous line) on the display region corresponding to the sewing region of a cloth holding portion and automatically arranges the plurality of sewing patterns (embroidery patterns) based on the sewing data selected from sewing data (embroidery data) stored in storage section along the set line at a predetermined interval, thereby displaying the same patterns on a display region and creating the integrated sewing data.

More specifically, the sewing machine includes display section having the display region corresponding to the sewing region of the cloth holding portion. The arbitrary continuous line is set to the same display region in the sewing machine so that the sewing machine can arrange the plurality of embroidery patterns based on embroidery data selected from an embroidery data group stored in the storage section along the set continuous line and can thus display them on the display region.

In the sewing machine, thus, it is possible to easily arrange and set the plurality of embroidery patterns along the continuous line by setting the continuous line and selecting desirable embroidery data. The embroidery patterns arranged along the continuous line are displayed on the display region of the display section so that a user can visually catch the same embroidery patterns. Therefore, it is possible to create the continuous embroidery pattern more easily.

Moreover, the sewing machine creates the integrated sewing data related to the embroidery patterns arranged along the continuous line, and furthermore, controls an operation of each portion of the sewing machine based on the integrated sewing data so that the continuous embroidery pattern can be formed on a workpiece.

According to a second aspect of the invention, the sewing machine may further include a change rate setting section which sets a change rate of sizes of the plurality of sewing patterns arranged along the line, wherein the pattern arranging section arranges the plurality of sewing patterns along the line such that the sizes the plurality of sewing patterns are enlarged or reduced stepwise in accordance with the change rate set by the change rate setting section.

According to the second aspect of the invention, in the sewing machine, it is possible to set the change rate of the sizes of the sewing patterns arranged along the line. Depending on the change rate thus set, therefore, it is possible to arrange the sewing patterns along the line while enlarging or reducing them stepwise.

More specifically, in the sewing machine, it is possible to set the change rate of sizes of the embroidery patterns arranged along the continuous line. Depending on the change rate thus set, therefore, it is possible to arrange the embroidery patterns to be enlarged or reduced stepwise along the continuous line.

In other words, when a plurality of embroidery patterns is to be arranged along the continuous line, the sewing machine can automatically arrange a continuous pattern in which the embroidery patterns are enlarged stepwise or a continuous pattern in which the embroidery patterns are reduced stepwise depending on the change rate set. Different from the related art, therefore, it is not necessary to set each arrangement for each embroidery pattern and to change the size. Consequently, it is possible to set the continuous embroidery pattern more easily.

The sewing machine can sew and form, onto a workpiece, a plurality of embroidery patterns enlarged or reduced stepwise.

According to a third aspect of the invention, the pattern arranging section may arrange the plurality of sewing patterns at regular intervals along the line.

According to the third aspect of the invention, when disposing a plurality of embroidery patterns along the continuous line, the sewing machine can arrange them at regular intervals.

Accordingly, the user can easily set the continuous embroidery pattern without adjusting each arrangement for each embroidery pattern as in the related art.

According to a fourth aspect of the invention, the pattern arranging section may arrange the plurality of sewing patterns along the line such that predetermined stitching ranges of the adjacent sewing patterns come in contact with each other.

According to the fourth aspect of the invention, moreover, when disposing a plurality of embroidery patterns along the continuous line, the sewing machine can arrange them at regular intervals such that predetermined stitching ranges of the embroidery patterns come in contact with each other.

Accordingly, the user can easily set the continuous embroidery pattern without adjusting each arrangement for each embroidery pattern as in the related art.

DESCRIPTION OF THE EXEMPLARY EMBODIMENTS

Hereinafter, exemplary embodiments of the invention will be explained with reference to the drawings, the following exemplary embodiments do not limit the scope of the invention.

In the exemplary embodiment, description will be given by taking an embroidery sewing machine as an example.

The embroidery sewing machine has a holding frame as a cloth holding portion which holds a workpiece cloth to be sewn. The embroidery sewing machine forms a stitching pattern based on predetermined sewing data on the cloth held by the holding frame by a relative moving the holding frame with respect to a needle.

In the description, a direction in which a needle 8 to be described below moves vertically is defined as a Z-axis direction (a vertical direction), a direction which is orthogonal to the Z-axis direction is defined as an X-axis direction (a transverse direction), and a direction which is orthogonal to both the Z-axis direction and the X-axis direction is defined as a Y-axis direction (a longitudinal direction).

Figure 1:
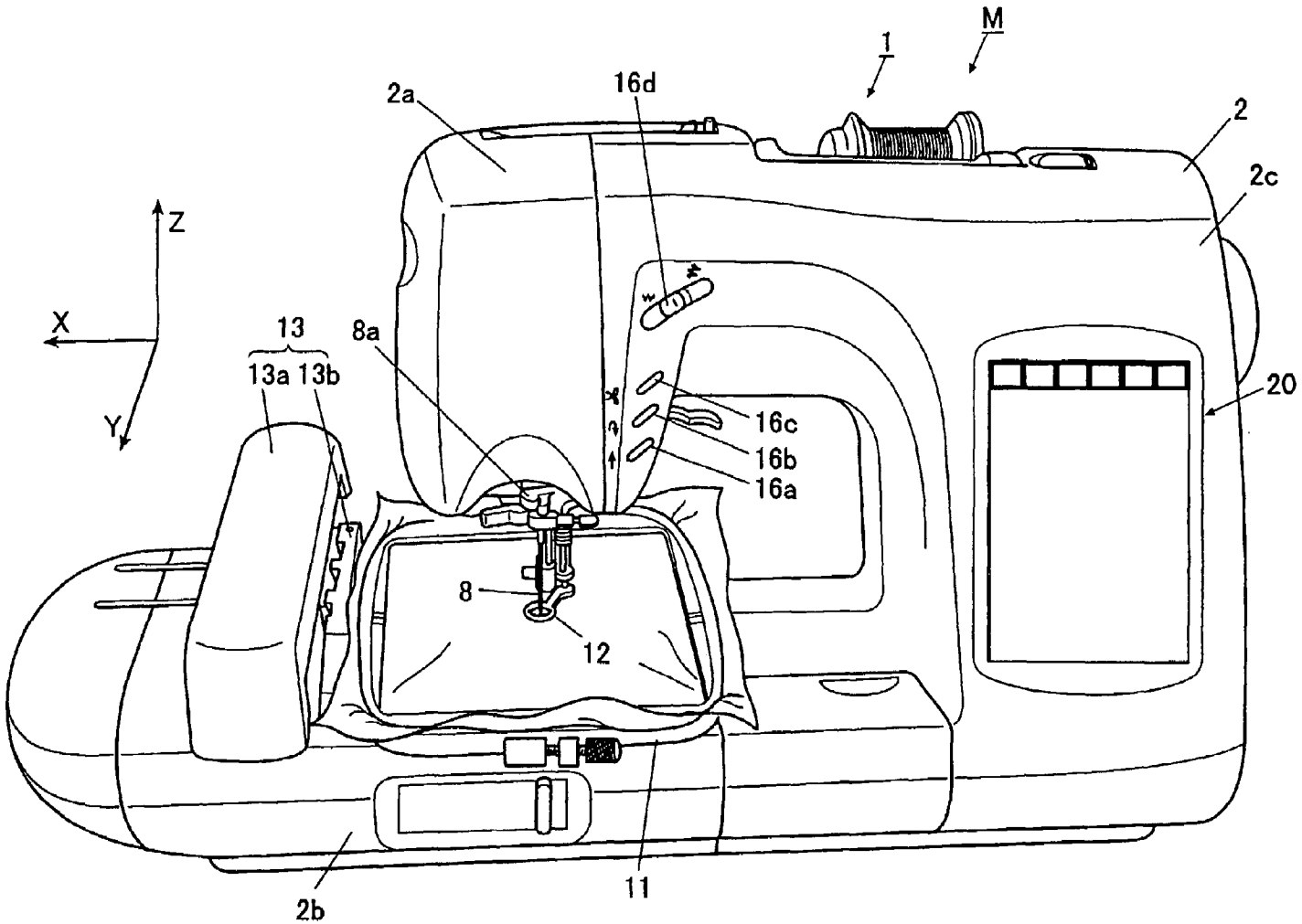
FIG. 1 is a perspective view showing a sewing machine according to an exemplary embodiment of the invention.
Figure 2:
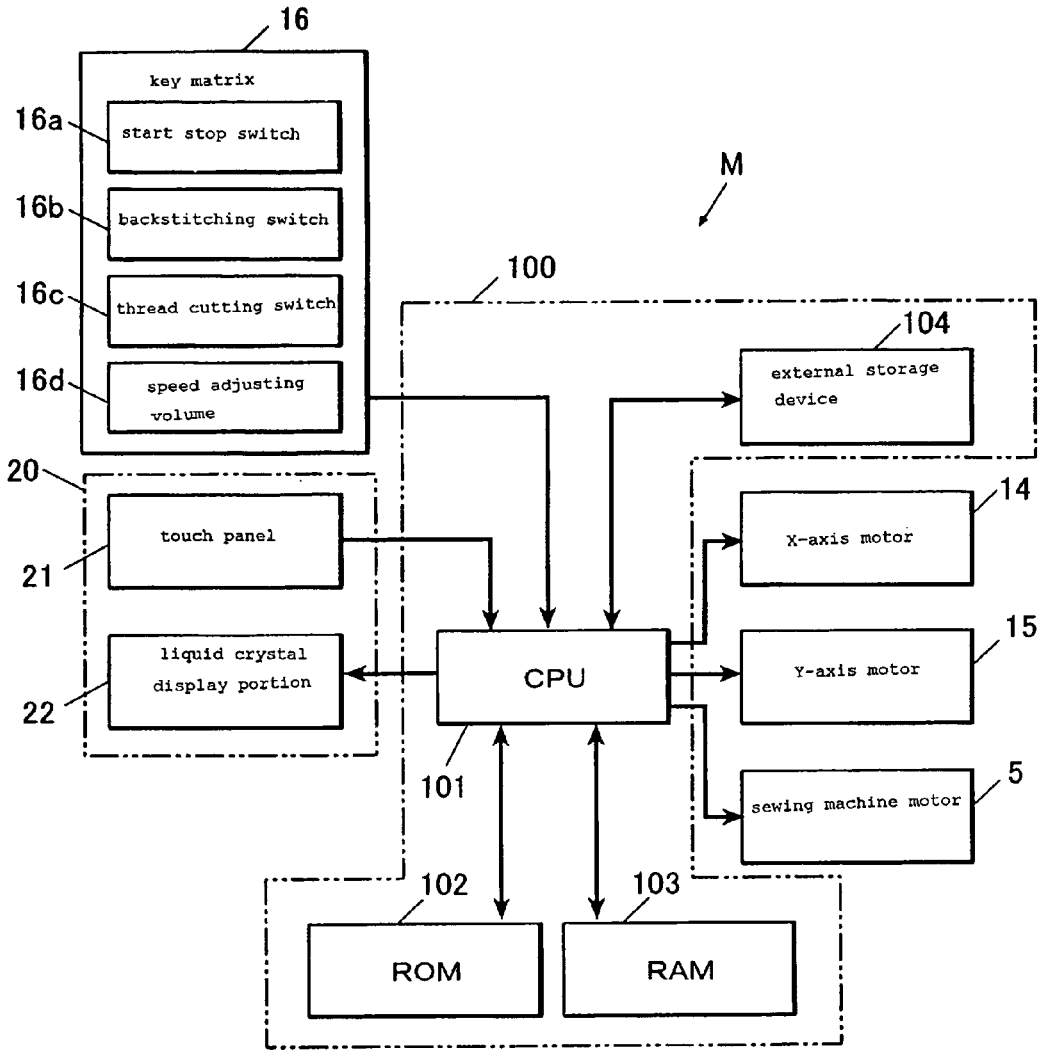
FIG. 2 is a block diagram showing a part of the structure of the sewing machine according to the exemplary embodiment of the invention.

As shown in FIGS. 1 and 2, an embroidery sewing machine M (hereinafter referred to as a sewing machine M) includes a sewing machine body 1 and a frame moving mechanism 13 provided in the sewing machine body 1.

As shown in FIG. 1, the sewing machine M includes a sewing machine frame 2 having an external shape of almost U when seen from a side. The sewing machine frame 2 has a arm portion 2*a* constituting an upper part of the sewing machine M and extending in the X-axis direction, a bed portion 2*b* constituting a lower part of the sewing machine M and extending in the X-axis direction, and a vertical drum portion 2*c* coupling the arm portion 2*a* and the bed portion 2*b*.

In the sewing machine M, a power transmitting mechanism is provided in the sewing machine frame 2 and has upper and lower shafts (not shown) which are rotatable and are extending in the X-axis direction. The upper shaft (not shown) is provided in the arm portion 2*a* and the lower shaft (not shown) is provided in the bed portion 2*b*.

The upper shaft (not shown) is connected to a sewing machine motor 5 (see FIG. 2) and a rotating force is applied by the sewing machine motor 5. Moreover, the lower shaft (not shown) is coupled to the upper shaft via a vertical shaft (not shown). When the upper shaft is rotated, a power of the upper shaft is transmitted to the lower shaft side via the vertical shaft (not shown) so that the lower shaft is rotated.

A needle bar 8*a*, which moves vertically in the Z-axis direction by the rotation of the upper shaft, is connected to a front end of the upper shaft (not shown), and the needle 8 is exchangeably provided on a lower end of the needle bar 8*a*. Moreover, the arm portion 2*a* is provided with a middle presser 12 which moves in the vertically direction interlockingly with the vertical motion of the needle bar 8*a* and presses a cloth around the needle 8 in order to prevent the cloth from being floated by the vertical motion of the needle 8.

Moreover, a shuttle (not shown) is provided on a front end of the lower shaft (not shown). When the lower shaft is rotated together with the upper shaft, stitches are formed by a cooperation of the needle 8 and the shuttle (not shown).

Since the connecting structure of the sewing machine motor 5, the upper shaft (not shown), the needle bar 8*a*, the needle 8, the lower shaft (not shown) and the shuttle (not shown) is the same as that in related art, detailed description will be omitted.

As shown in FIG. 1, moreover, the bed portion 2*b* is provided with a frame moving mechanism 13 having a carriage

13*a* and an attachment member 13*b*. A holding frame 11 (a cloth holding portion) attached to the attachment member 13*b* and the needle 8 attached to the arm portion 2*a* are disposed above the bed portion 2*b*.

The holding frame 11 is attached to the frame moving mechanism 13 via the attachment member 13*b*. Pulse motors such as an X-axis motor 14 and a Y-axis motor 15 disposed inside the carriage 13*a* or the sewing machine bed 2*b* are coupled to the attachment member 13*b* as a driving mechanism portion (see FIG. 2).

The holding frame 11 holding a workpiece cloth is moved in longitudinal and the transverse directions (X-Y directions) by the driving operation of the X-axis motor 14 and the Y-axis motor 15 of the frame moving mechanism 13, thereby positioning the held cloth with respect to the needle 8. The movement of the holding frame 11 and the operations of the needle 8 and the shuttle (not shown) are interlock with each other so that a needle location based on predetermined sewing data (particularly, sewing data obtained by combining a plurality of embroidery data corresponding to a plurality of embroidery patterns to be arranged along a continuous line L which will be described below) is applied to the cloth, stitches are formed. An embroidery stitching having a desirable shape is formed on the cloth held inside the holding frame 11, that is inside a predetermined sewing region of the holding frame 11.

In other words, the sewing machine M has the holding frame 11, an inner side of which is a sewing allowable area for sewing (a sewing region), and forms an embroidery stitching having a desirable shape within a sewing allowable range of the cloth held on the inner side of the holding frame 11 by locating a needle so as to form an embroidery pattern corresponding to the sewing data.

Moreover, as shown in FIGS. 1 and 2, the sewing machine M includes a key matrix 16 having a start-stop switch 16*a*, a backstitching switch 16*b*, a thread cutting switch 16*c* and a speed adjusting volume 16*d*.

The key matrix 16 has the function of an operation key for driving the sewing machine M, vertically moving the needle bar 8*a* (needle 8) and operating the holding frame 11. More specifically, signals output based on the operation of the key matrix 16 is input as operation signals for various keys to a control portion 100 which will be described below, and the control portion 100 drives the sewing machine motor 5 in response to the operation signals, thereby operating the sewing machine M.

Furthermore, as shown in FIGS. 1 and 2, the sewing machine M includes an operation panel 20 for an operator to carry out various setting operations of the sewing machine and an input operation for various data. The operation panel 20 and the control portion 100 are connected to each other via a line which is not shown.

As shown in FIG. 2, the operation panel 20 includes a liquid crystal display portion 22 as display section and a touch panel 21 provided on a display screen of the liquid crystal display portion 22 (on a front surface of the display screen) as a transparent touch switch. When touching the operation key displayed on the liquid crystal display portion 22, a position where the touch panel 21 is touched is detected, for example, by a position reading principles of an electromagnetic induction type, a magnetic distortion type or a pressure-sensitive type. Various data and an operation instruction is input corresponding to the detected position. For example, when an operation key displayed on the operation panel 20 is touched to input a instruction for a predetermined operation, an image displayed on the liquid crystal display portion 22 of the operation panel 20 is variously switched, so that various operation screens including operation keys and set data are displayed. Moreover, a signal input by a touch on the operation panel 20 is output to the control portion 100 which will be described below. Thus, the operation panel 20 has a function as an input portion and a display portion in the sewing machine.

Moreover, the liquid crystal display portion 22 has a display region 22*a* (see FIG. 3) having which substantially corresponds to the sewing region and displays an embroidery pattern.

As shown in FIGS. 3 to 10, a group of operation keys that is displayed on the operation panel 20 includes, for example, a decision key 21*a*, a cancel key 21*b*, a pattern selecting key 21*c* and a size setting portion 21*d*. The decision key 21*a*, as a continuous line setting section, decides continuous indicating points P input with respect to the display region 22*a* and sets a continuous line L, which will be described below, based on the continuous indicating points P. The cancel key 21*b* cancels the continuous line L which is set. The pattern selecting key 21*c* displays an embroidery data list screen 210 (see FIG. 6) including an embroidery data selecting key 210*a* as one of a selecting section which selects desirable embroidery data from a plurality of embroidery data stored in a storage section which will be described below. The size setting portion 21*d* is one of a change rate setting section which sets a change rate of sizes of embroidery patterns arranged along the continuous line L in which the sizes of embroidery patterns change along the continuous line L.

The size setting portion 21*d* includes a plus key 211 for increasing a value of the change rate, a minus key 212 for decreasing the value of the change rate, a determination key 213 for determining the change rate which is input, and a change rate display frame 214 for displaying the value of the change rate that is set.

Together with the group of operation keys, the liquid crystal display portion 22 displays, in the display region 22*a*, the continuous indicating points P, the continuous line L set based on the continuous indicating points P, and embroidery patterns that are based on the embroidery data and arranged along the continuous line L.

The display region 22*a* corresponds to the sewing region on the inner side of the holding frame 11, and the embroidery patterns displayed on the display region 22*a* are sewn and formed on corresponding positions of the cloth held within the inner side (the sewing region) of the holding frame 11.

As shown in FIG. 2, moreover, the sewing machine M includes the control portion 100 connected to the sewing machine motor 5, the X-axis motor 14, the Y-axis motor 15, the operation panel 20 and the key matrix 16.

The control portion 100 includes a CPU 101, a ROM 102, a RAM 103, an external storage device 104, an interface (not shown) for connecting the CPU 101 to various devices, and a pulse motor driver (not shown) for each motor. The CPU 101 executes various processes and controls for the sewing machine motor 5, the X-axis motor 14, the Y-axis motor 15, the operation panel 20 and other actuators which are not shown, in accordance with a predetermined control program. The ROM 102 is one of the storage section which stores a program for executing various processes and controls, and data required for the various processes and controls. The RAM 103 stores various data for various processes, and serves as a work area. The external storage device 104 is one of the storage section which is removable.

The CPU 101 intensively controls an operation processing of each portion of the sewing machine in accordance with various control programs for an electronic cycle sewing machine stored in the ROM 102 and various sewing data stored in the external storage device 104, in response to an operation signal input from the key matrix 16, various setting signals input from the operation panel 20 and various data. Further, the CPU stores a result of the processing in a work area of the RAM 103, and furthermore, stores various data input by the operation of the operation panel 20 and the result of the processing stored in the RAM 103 in the external storage device 104 if necessary.

The CPU 101 functions as control section which controls the driving operation of each portion of the sewing machine M.

The control program and control data of the sewing machine M, data related to various sewing operations and display screen information are stored in the ROM 102.

For example, various embroidery data related to a plurality of stitching shapes (sewing patterns) for operating the needle bar 8*a* (the needle 8) and the holding frame 11 are prestored in the ROM 102 in order to form various stitches on the workpiece. For the embroidery data, coordinates of shape points indicative of the shape of the stitching (shape point data) and coordinates of a needle location calculated based on the shape point (needle location data) are stored as coordinate data (coordinate points) of the needle location position related to the position of the needle 8 with respect to the holding frame 11. Moreover, moving amount data related to an amount of the movement in a relative movement of the holding frame 11 with respect to the needle 8 are stored in order to locate the needle 8 in the position of the coordinate data.

Various work memories and counters are provided in the RAM 103 and are used as work areas during a processing of data input or during a sewing operation.

The external storage device 104 is, for example, a so-called nonvolatile flash memory, and stores such as embroidery data and sewing data that are not stored in the ROM 102, display screen information, and sewing data set by an operator through the operation panel 20.

The sewing data stored in the external storage device 104 includes integrated sewing data created by the CPU 101, which is one of a sewing data creating section described below, based on selected embroidery data.

For example, in case where embroidery patterns are arranged along the continuous line L displayed in the display region 22*a* as will be described below, the integrated sewing data is created by changing and regulating the shape point data and the needle location data (coordinate data and moving amount data) included in the embroidery data, in accordance with deformations of the embroidery patterns when arranged along the continuous line L.

The control portion 100 processes driving signals input from an X-axis origin sensor (not shown) provided together with the X-axis motor 14, a Y-axis origin sensor (not shown) provided together with the Y-axis motor 15 and the key matrix 16, various setting data input from the operation panel 20 and various data stored in the ROM 102 and the external storage device 104 in accordance with various control programs for the electronic cycle sewing machine which are stored in the ROM 102, and executes the controls for each of the motors, the operation panel 20 or the other actuators.

In the execution of the sewing operation, the CPU 101, as a control section, executes a predetermined control program, thereby reading the sewing data stored in the ROM 102 or the external storage device 104 to drive the sewing machine motor 5 and to drive the X-axis motor 14 and the Y-axis motor 15 in order to obtain a needle location indicated by the sewing data. More specifically, the CPU 101 executes a processing of positioning the holding frame 11 in order in a plurality of needle locations based on coordinate data set to the sewing data in synchronization with the rotation of the sewing machine motor 5, continuously carrying out a control for locating the needle 8 till the completion of the sewing operation, thereby sewing and forming a predetermined embroidery pattern on a cloth.

Moreover, the CPU 101 functions as a part of the continuous line setting section which receives the input of the continuous indicating point P, which is input by touching the display region 22*a* of the liquid crystal display portion 22, and sets the continuous line L based on a plurality of continuous indicating points P that is input.

More specifically, based on the coordinate data of the continuous indicating points P input by touching the display region 22*a* of the operation panel 20, a spline curve to be the continuous line L is created and set by carrying out a spline processing over the continuous indicating points P with the press-down of the decision key 21*a*. The spline processing itself is well-known.

Further, based on a selection through the press-down of the embroidery data selecting key 210*a* of the operation panel 20, the CPU 101 functions as a part of the selecting section which selects embroidery data that corresponds to the selection from the embroidery data stored in the ROM 102.

Moreover, the CPU 101 functions as a pattern arranging section which arranges a plurality of embroidery patterns along the continuous line L set by the continuous line setting section, and displays them on the display region 22*a* of the operation panel 20.

In particular, the CPU 101, as one of the pattern arranging section, arranges embroidery patterns along the continuous line L such that predetermined stitching ranges of the embroidery patterns come in contact with each other, or such that the stitching ranges have regular intervals therebetween along the continuous line L. Whether the embroidery patterns are arranged at regular intervals or adjacently to each other can be selectively set by an operation of a switching key displayed on the operation panel 20.

In addition, the pattern arranging section determines the number of the embroidery patterns that can be arranged along the continuous line L set, thereby arranging the determined number of embroidery patterns along the continuous line L.

Moreover, the pattern arranging section executes a control for arranging a plurality of embroidery patterns along the continuous line L so as to be enlarged or reduced sequentially and stepwise in accordance with a change rate set by the CPU 101 to be change rate setting section which will be described below.

Furthermore, the CPU 101 functions as a sewing data creating section which creates integrated sewing data related to a plurality of embroidery patterns arranged along the continuous line L by the pattern arranging section (for example, a continuous embroidery pattern including a plurality of embroidery patterns).

In addition, the CPU 101 functions as a part of the change rate setting section which sets a change rate such that sizes of embroidery patterns to be arranged along the continuous line L changes along the continuous line L based on the operation of the size setting portion 21*d* of the operation panel 20.

Moreover, the CPU 101 functions as a display control section which controls the display of the liquid crystal display portion 22 in the operation panel 20.

Figure 11:
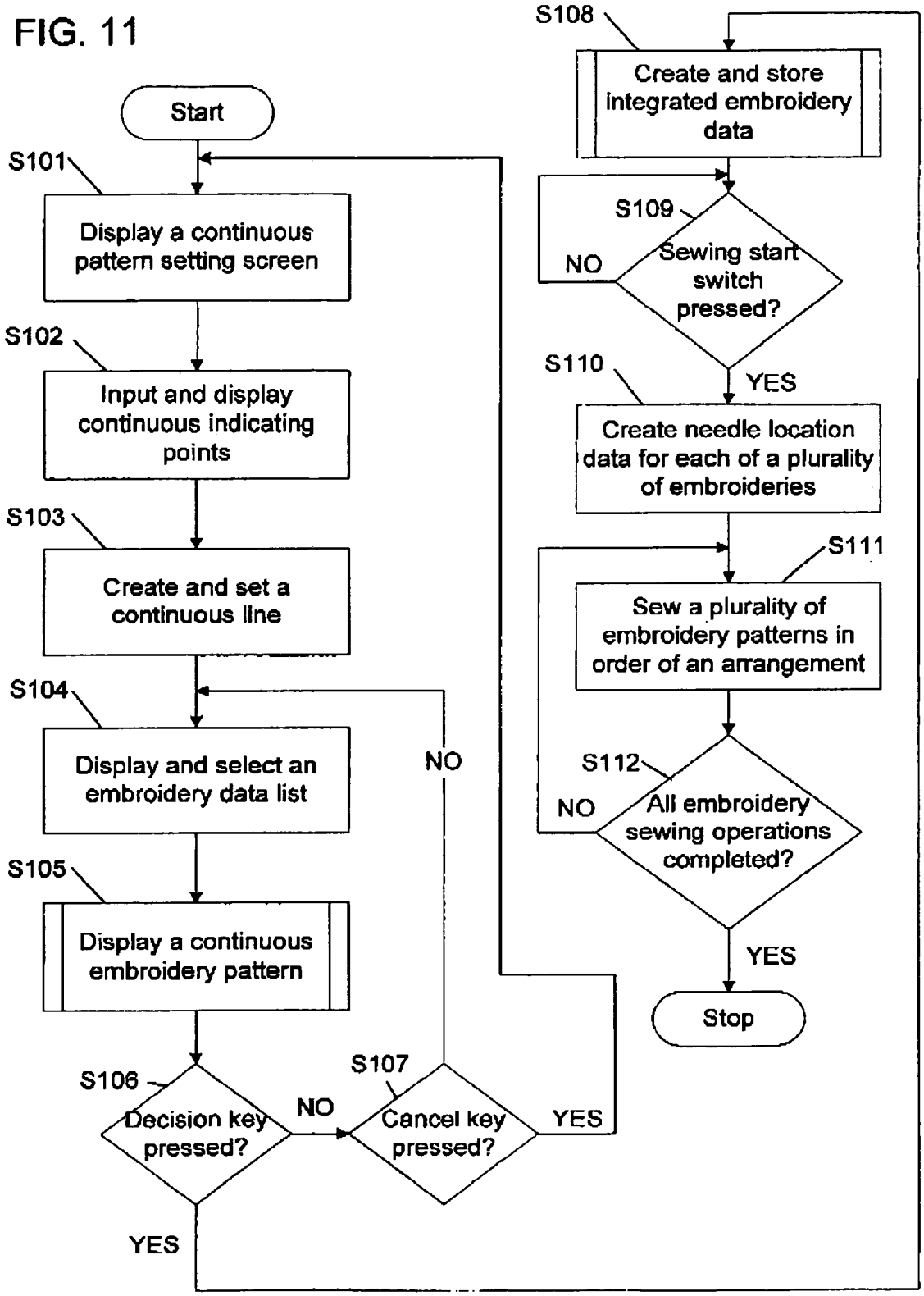
FIG. 11 is a flowchart showing a processing operation to be carried out when continuously forming a plurality of embroidery patterns on a cloth in the sewing machine according to the exemplary embodiment of the invention.
Figure 12:
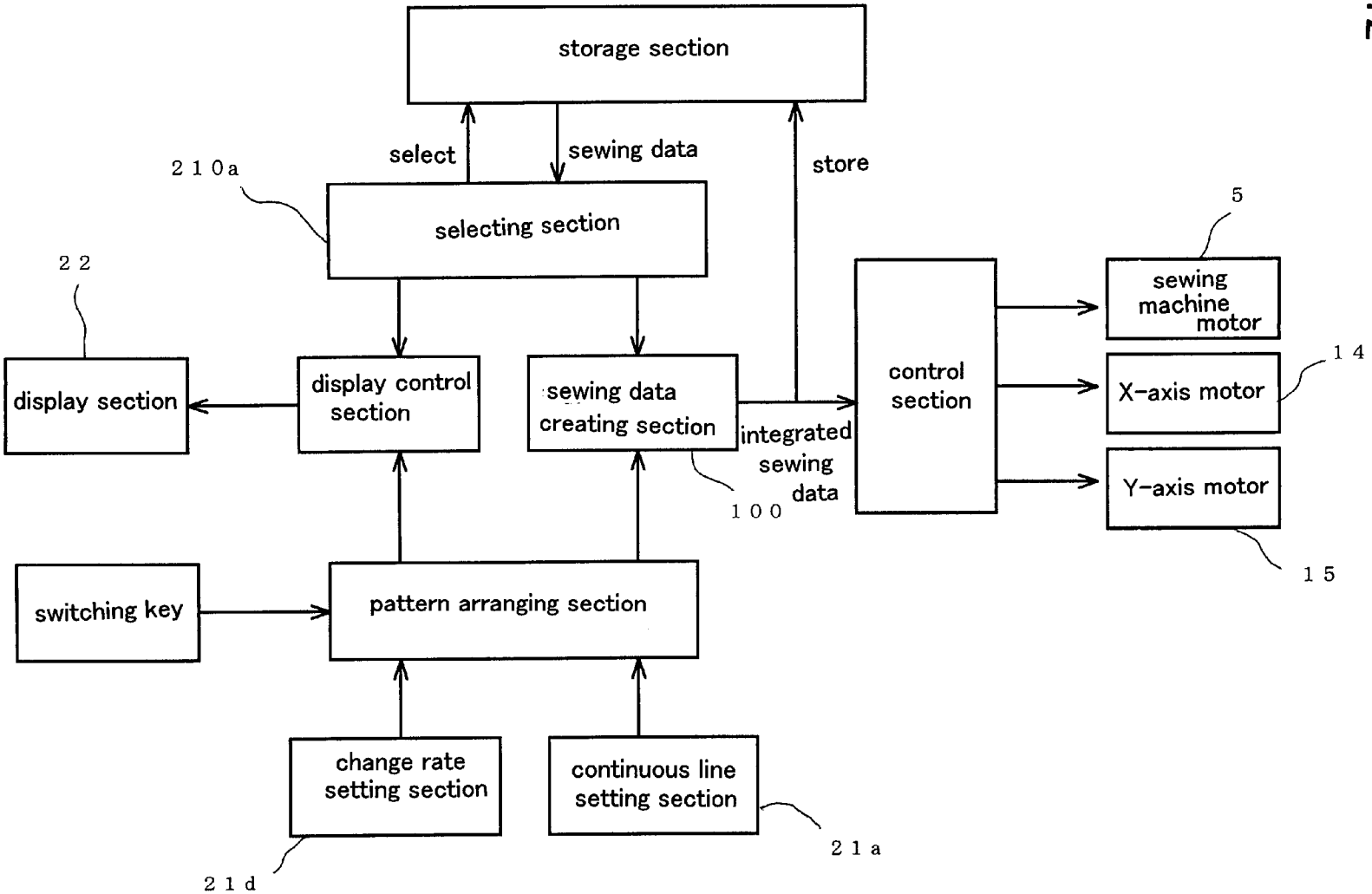
FIG. 12 is a functional block diagram according to the exemplary embodiment of the invention.

Next, processing operations to be carried out when continuously forming a plurality of embroidery patterns on a cloth with the sewing machine M according to the embodiment will be described with reference to a flowchart shown in FIG. 11.

Figure 3:
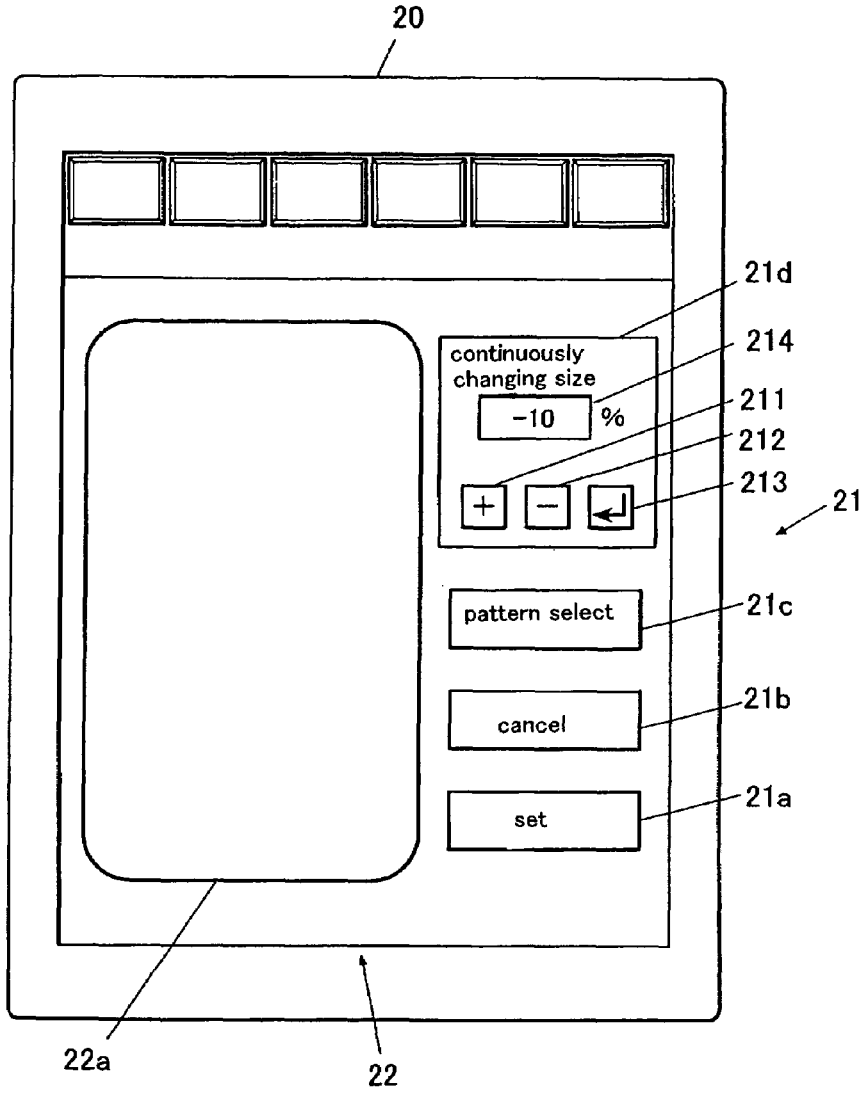
FIG. 3 is a plan view showing an example of an operation panel of the sewing machine according to the exemplary embodiment of the invention.

First of all, when a predetermined operation key is pressed down on the operation panel 20, the display control section controls the operation panel 20 to display a continuous pattern setting screen including the display region 22*a* as shown in FIG. 3 for example (Step S101).

The size setting portion 21*d* is displayed on the continuous pattern setting screen. The size setting portion 21*d* sets a change rate of a pattern size when arranging the embroidery patterns along the continuous line as will be described below, and is defaulted to −10% at the beginning. In this stage, the plus key 211 and the minus key 212 may be operated to change the change rate.

Figure 4:
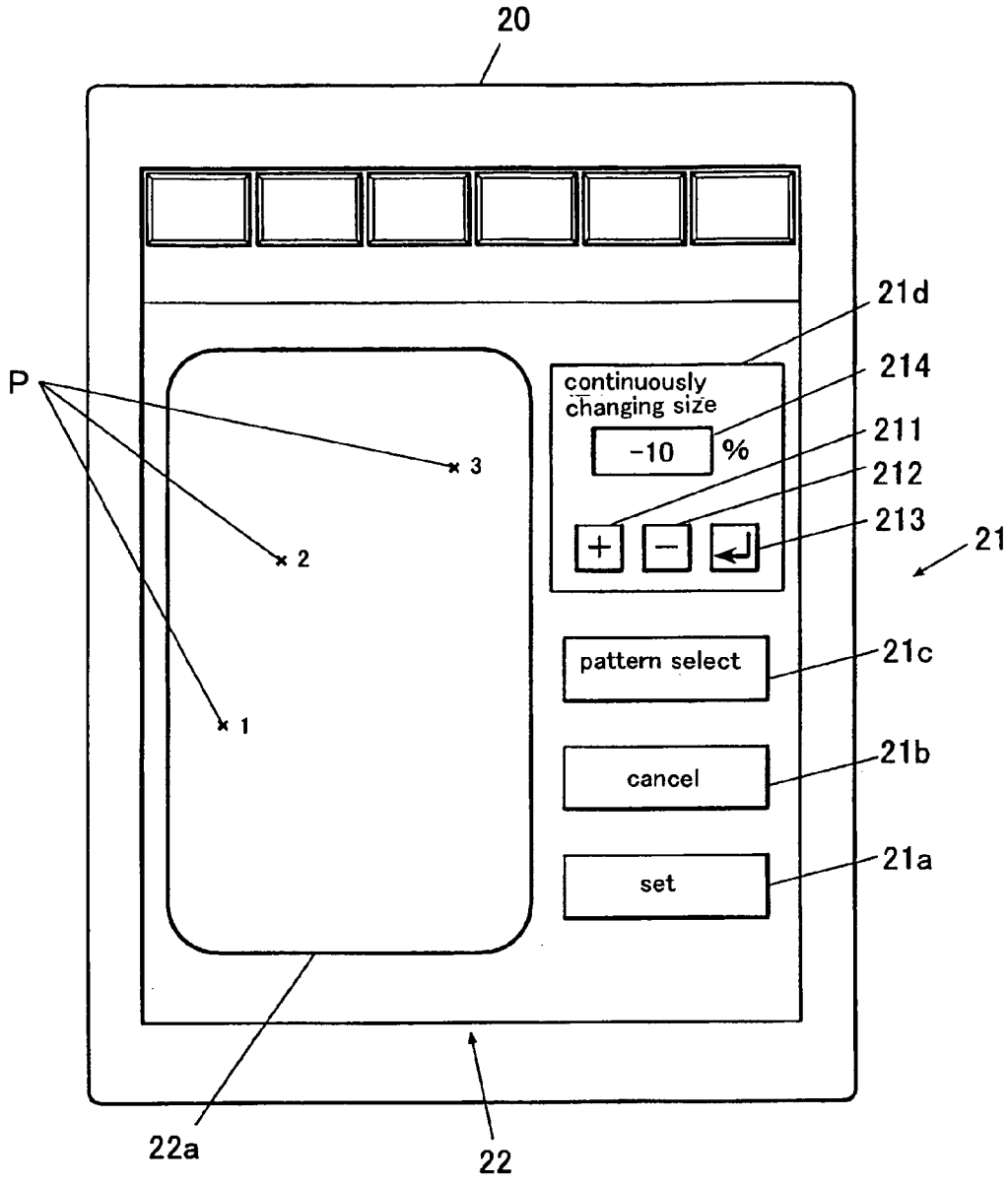
FIG. 4 is a plan view showing another example of the operation panel on which a continuous indicating point is displayed in a display region.

When three portions are touched with fingers on the display region 22*a* of the operation panel 20, subsequently, coordinate data on positions indicated by the touching operations are acquired. Further, as shown in FIG. 4, "X" and numbers are displayed as the continuous indicating points P at respective positions on the display region 22*a* (Step S102).

Figure 5:
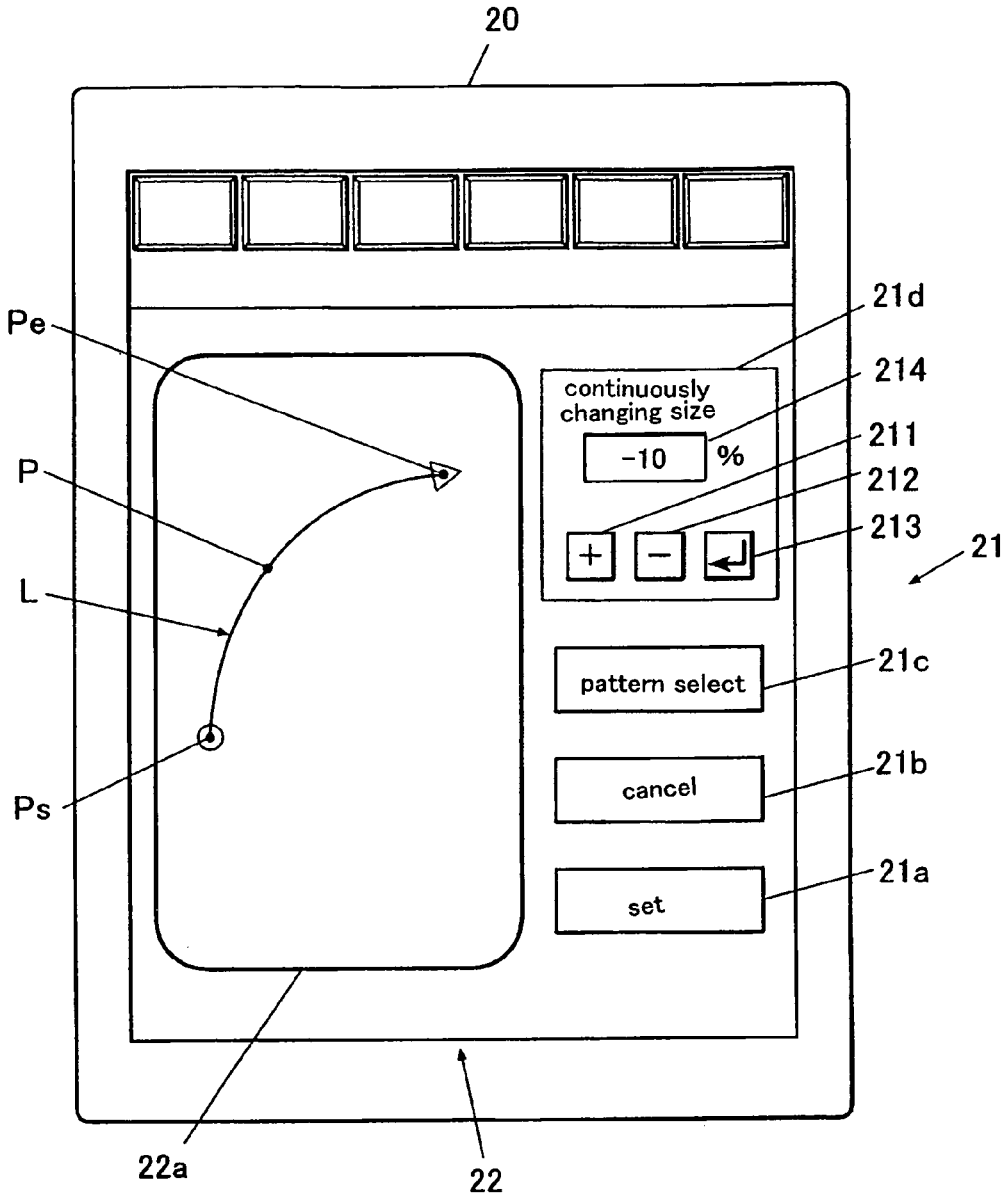
FIG. 5 is a plan view showing another example of the operation panel on which a continuous line is displayed in the display region.

Then, when the decision key 21*a* of the operation panel 20 is pressed down, the line L passing through the three points is created in which a first indicating point P(1) is set a start point Ps and a third indicating point P(3) is set an end point Pe as shown in FIG. 5 (Step S103, continuous line setting section).

Figure 6:
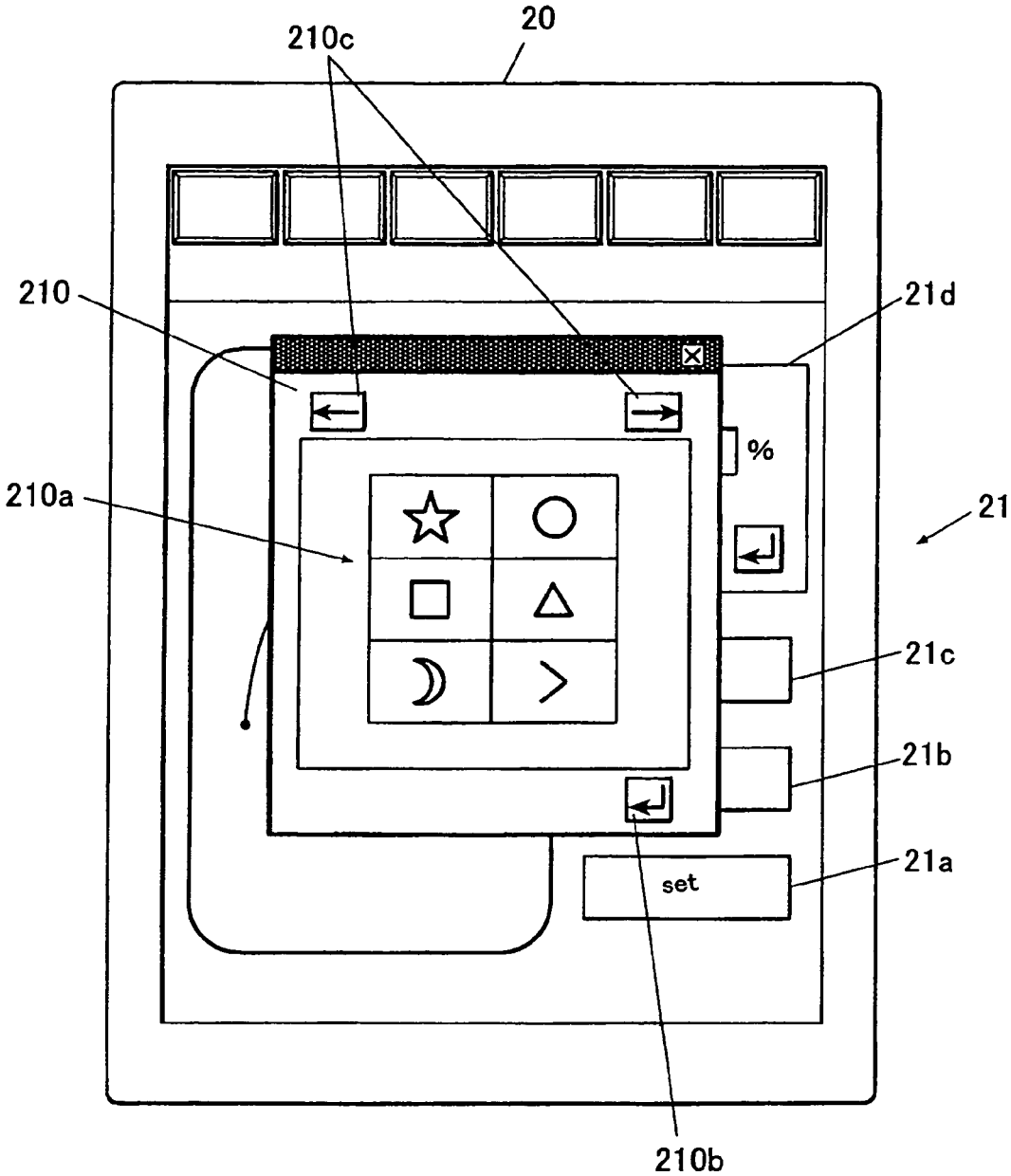
FIG. 6 is a plan view showing another example of the operation panel on which an embroidery data screen is displayed.

Next, when the pattern selecting key 21*c* of the operation panel 20 is pressed down, the embroidery data list screen 210 is displayed on the operation panel 20 as shown in FIG. 6.

On the embroidery data list screen 210, the embroidery data selecting key 210*a* is displayed together with six kinds of patterns, for example, a star shape, a round shape, a square shape, a triangular shape, a crescent shape and a zigzag shape. When a pattern switching key 210*c* is pressed down, thereafter, the embroidery data selecting key 210*a* corresponding to embroidery patterns other than the six types are displayed.

When the embroidery data selecting key 210*a* corresponding to any of the patterns is pressed down, and then a determination key 210*b* is pressed down, embroidery data of the pertinent pattern is selected (Step S104, selecting section).

Figure 7:
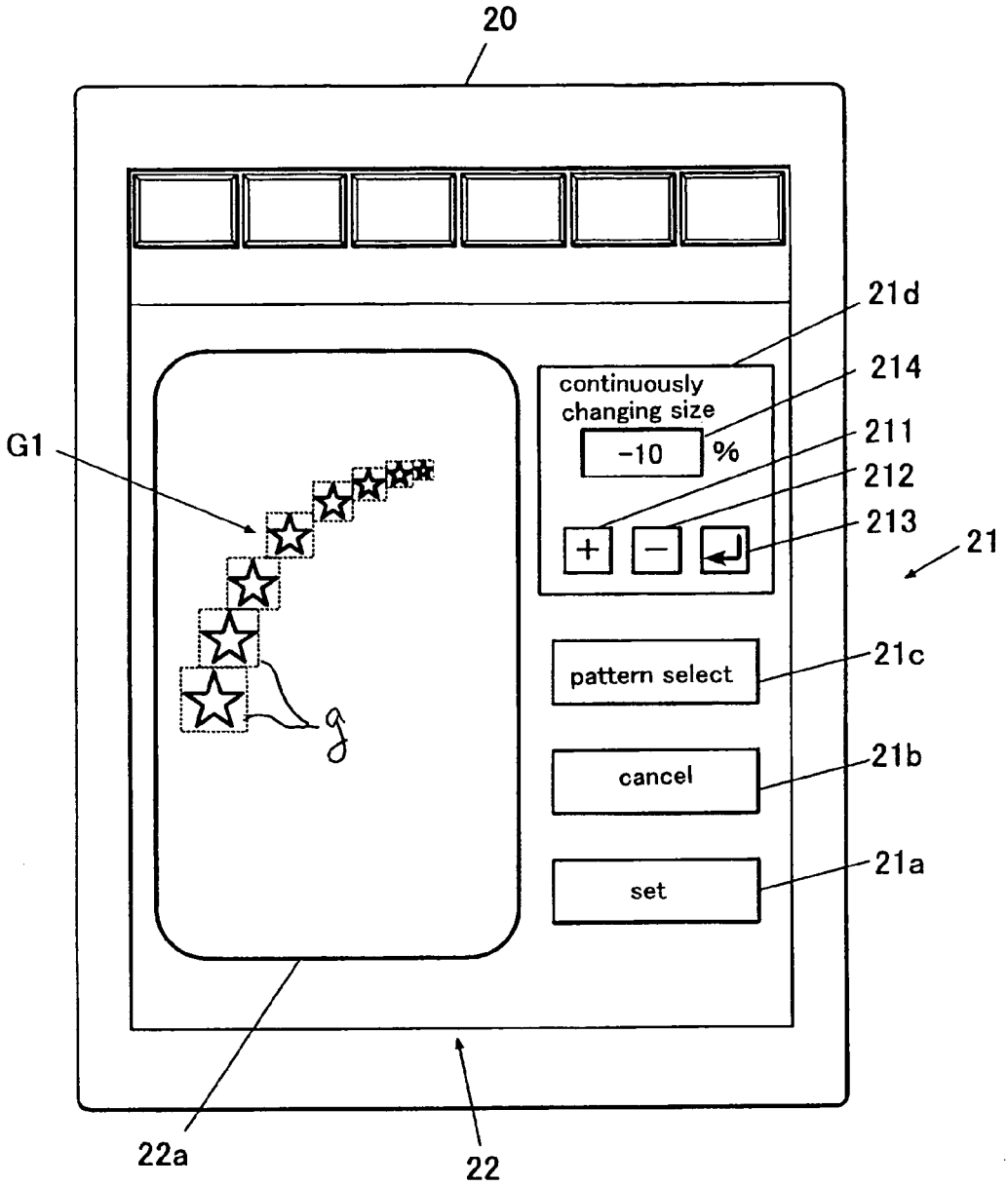
FIG. 7 is a plan view showing another example of the operation panel on which an embroidery pattern arranged along a continuous line is displayed in the display region.

By the operation of the determination key 210*b*, a plurality of selected embroidery patterns, for example, a star-shaped continuous embroidery pattern G1 along the continuous line L is arranged and displayed on the display region 22*a* as shown in FIG. 7 (Step S105, pattern arranging section).

The change rate of the "continuously changing size" is default set to be "−10%" via the size setting portion 21*d*. Therefore, the embroidery pattern corresponding to the selected embroidery data is arranged on the start point Ps side of the continuous line L in a size of 100%, and embroidery patterns having a size of 90% and 80% are then sequentially arranged toward the end point Pe side of the continuous line L so that the sizes of the embroidery patterns are gradually reduced.

In FIG. 7, eight star-shaped embroidery patterns are arranged along the continuous line L. This number of the embroidery patterns to be arranged is automatically determined as an allowable number based on a length of the continuous line L and the change rate.

Figure 13:
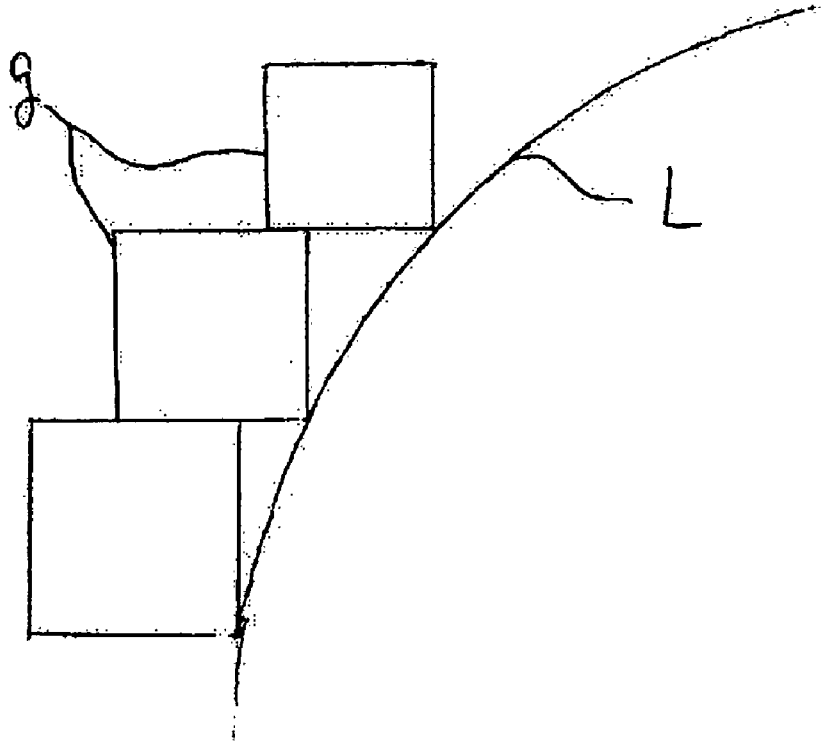
FIG. 13 is an explanatory view showing an arrangement of a continuous pattern.

These setting operations are carried out by the following method. First, a predetermined stitching range in each of the embroidery patterns arranged along the continuous line L, that is, a rectangular range (g) shown in a dotted lines around the star shapes in FIG. 7 is set on data. Then, the rectangular ranges are sequentially arranged along the continuous line L such that, for example, right end points in an X direction on lower side lines of the rectangular ranges are positioned on the continuous line, and such that the lower side line of the rectangular range comes into contact with an upper side line of the rectangular range of the previous pattern (see FIG. 13).

Subsequently, it is decided whether the decision key 21*a* of the operation panel 20 is pressed down or not (Step S106).

If it is decided that the decision key 21*a* is pressed down (Step S106; Yes), the processing proceeds to Step S108.

On the other hand, if it is decided that the decision key 21*a* is not pressed down (Step S106; No) and the cancel key 21*b* is pressed down (Step S107; Yes), the display in the display region 22*a* is erased, for example, and the processing returns to the Step S101.

At the Step S108, the integrated sewing data including various data on the continuous embroidery pattern G1 formed by a plurality of (eight in FIG. 7) star-shaped embroidery patterns arranged along the continuous line L is created and stored in the external storage device 104 (Step S108). Such integrated sewing data relates to such as an arrangement position and a size of each star shape in the continuous embroidery pattern G1.

Then, if it is decided that the predetermined sewing start switch 16*a* of the sewing machine M is pressed down (Step S109; Yes), the integrated sewing data related to the star-shaped continuous embroidery pattern G1 and stored in the external storage device 104 is converted into stitching data which is needle location data for each star shape (Step S110; sewing data creating section).

Thereafter, the driving operations of the X-axis driving motor, Y-axis driving motor and the sewing machine motor are controlled to execute a sewing processing such that a plurality of (eight) star-shaped embroidery patterns of the continuous embroidery pattern G1 are formed in an arranged order (Step S111, control section).

Next, it is decided whether a work for sewing all (eight) star-shaped embroidery patterns of the star-shaped continuous embroidery pattern G1 are executed or not (Step S112).

If it is decided that the work for sewing all of the start-shaped patterns is not executed (Step S112; No), the processing returns to the Step S111.

On the other hand, if it is decided that the work for sewing all of the star-shaped patterns is executed (Step S112; Yes), the sewing machine M ends a series of sewing processings.

In the sewing machine M according to the exemplary embodiment of invention, thus, it is possible to input the continuous indicating points P by touching the display region 22*a* of the operation panel 20. Further, the sewing machine M can create the continuous line L based on the continuous indicating points P, and carry out a setting operation for arranging a plurality of embroidery patterns continuously along the continuous line L. In other words, it is not necessary to carry out a complicated work in which an arrangement for each embroidery pattern is set individually in order to continuously arrange a plurality of embroidery patterns as in the related art. Moreover, the sewing machine M also changes a size for each embroidery pattern automatically. Therefore, it is possible to set the arrangement of the embroidery pattern more easily.

Furthermore, the sewing machine M can easily create the sewing data related to the continuous embroidery pattern G1 having a plurality of embroidery patterns arranged along the continuous line L.

Accordingly, the sewing machine M can sew and form the continuous embroidery pattern G1 including a plurality of continuous embroidery patterns on a cloth based on the created sewing data.

The present invention is not restricted to the exemplary embodiment.

Figure 8:
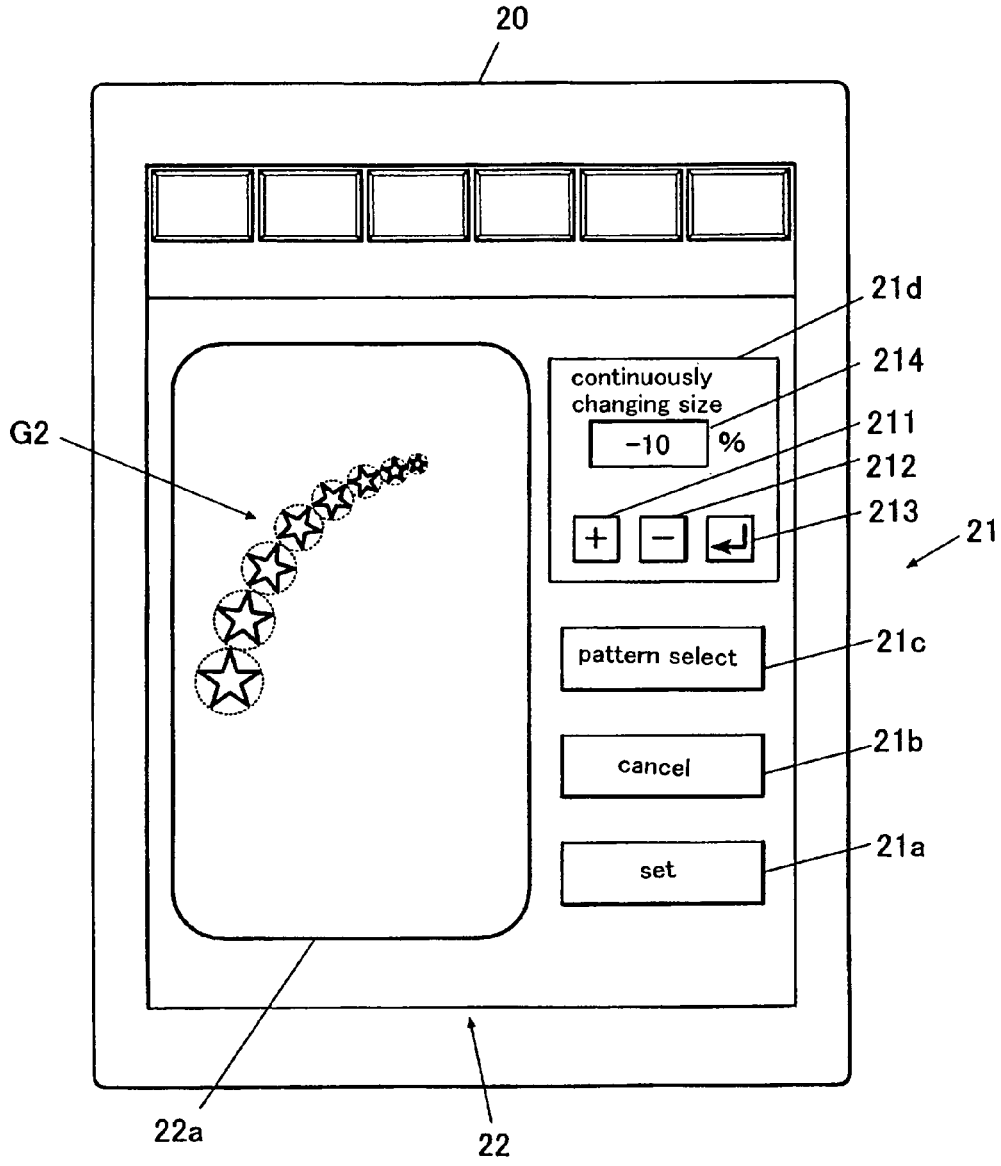
FIG. 8 is a plan view showing another example of the operation panel on which another embroidery pattern arranged along the continuous line is displayed in the display region.

For example, it is also possible to set a continuous embroidery pattern G2 shown in FIG. 8 by carrying out a setting operation in which arrangement angles are changed so as to gradually rotate a plurality of embroidery patterns when arranging them along the continuous line L.

In FIG. 8, a predetermined stitching range in each embroidery pattern arranged along the continuous line L, that is, a circular range shown in a dotted line around a star shape comes in contact, and a central point of the circle is positioned on the continuous line L so that a plurality of star-shaped embroidery patterns is arranged along the continuous line L.

Figure 9:
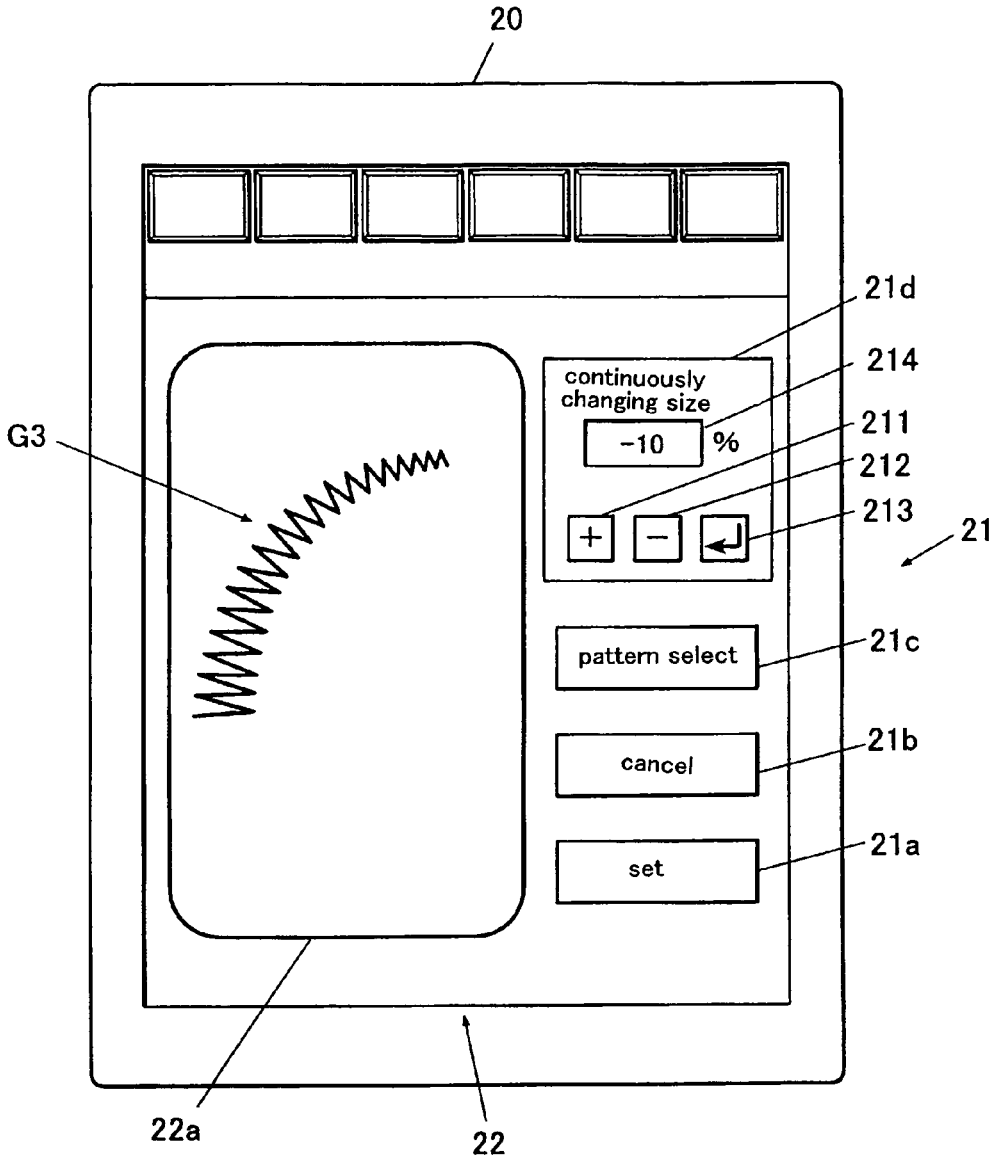
FIG. 9 is a plan view showing another example of the operation panel on which another embroidery pattern arranged along the continuous line is displayed in the display region.

As in a continuous embroidery pattern G3 shown in FIG. 9, moreover, the embroidery patterns may be arranged at regular intervals along the continuous line L so as to have an identical sewing pitch, thereby creating a continuous pattern such as a zigzag stitch.

Figure 10:
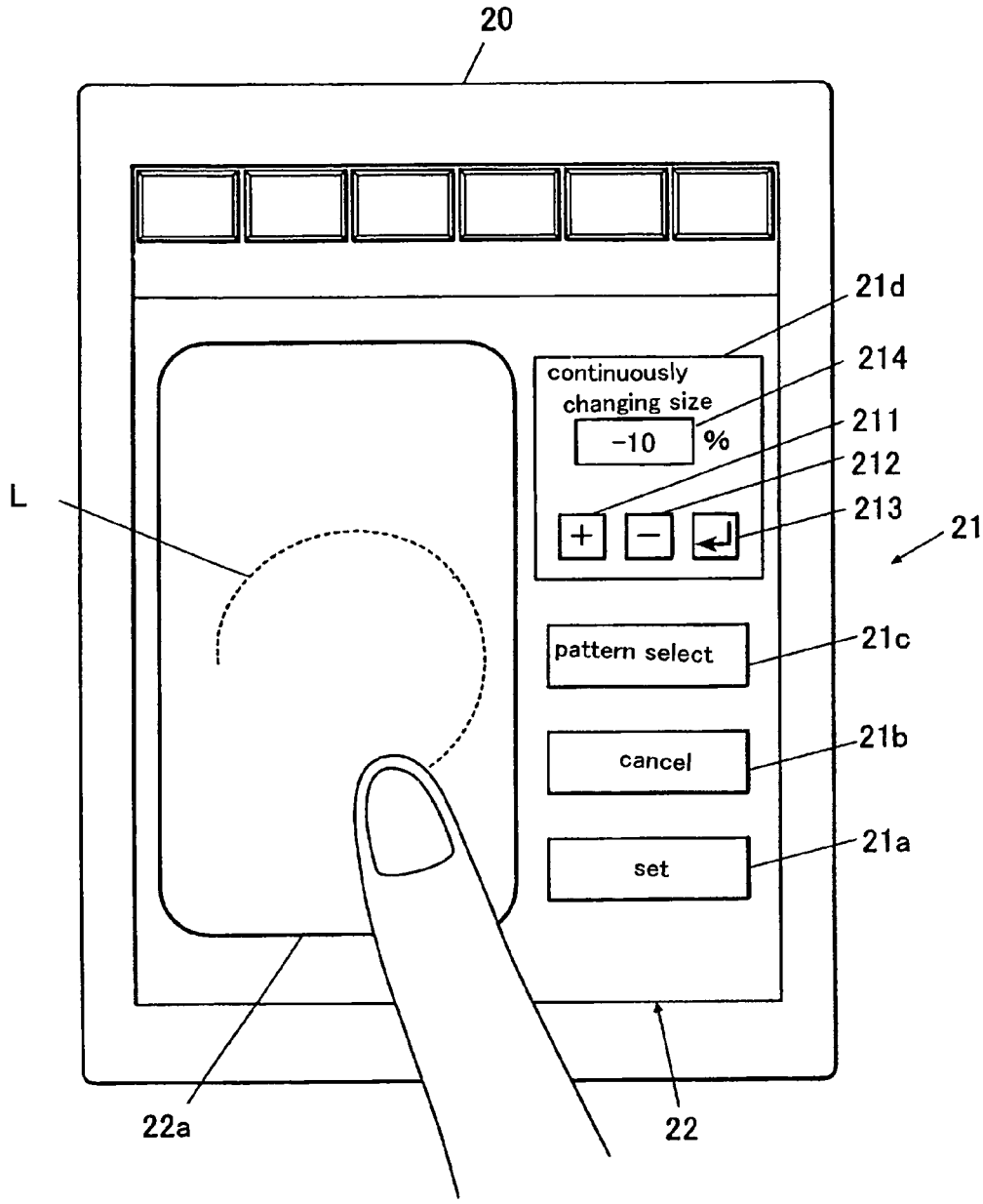
FIG. 10 is a plan view showing another example of the operation panel on which a continuous line is input in the display region.

While the description has been given by taking, as an example, the case in which a plurality of continuous indicating points P is input and set on the display region 22*a* of the operation panel 20, and the spline processing is carried out over the continuous indicating points P to create and set the continuous line L in the embodiment, the invention is not restricted thereto. For example, an arrangement may be set on a straight line having two points designated, or the display region 22*a* may be traced with a finger so as to draw, input and seta continuous line L as shown in FIG. 10.

Further, while the description has been given by taking, as an example, the case in which an allowable number of embroidery patterns that is capable of being arranged on the set continuous line L are arranged in the embodiment, the invention is not restricted thereto. For example, a desirable number of embroidery patterns may be disposed on the continuous line L at desirable intervals.

Furthermore, although the description has been given by taking, as an example, the case in which an embroidery pattern corresponding to reference embroidery data is arranged on the start point Ps side of the continuous line L in a size of 100% in the embodiment, the invention is not restricted thereto. For example, it is also possible to set a size of an embroidery pattern to be firstly arranged, and to regulate sizes of other continuous embroidery patterns based on the size set for the firstly arranged embroidery pattern.

Furthermore, while the description has been given by taking, as an example, the case in which the change rate of the "continuously changing size" is set to be minus in the size setting portion 21*d*, and the arrangement is carried out such that the sizes the embroidery patterns are gradually reduced in the embodiment, the invention is not restricted thereto. For example, the change rate of the "continuously changing size" may be set to be plus, and the arrangement may be carried out such that the sizes of the embroidery patterns is enlarged stepwise.

In case where the change rate of the "continuously changing size" is set to be "0%" in the size setting portion 21*d*, all of the continuous embroidery patterns are set to have equal sizes.

Furthermore, although the description has been given such that the integrated sewing data related to the desirable continuous embroidery pattern are created, and then, the operation for sewing the embroidery based on the integrated sewing data is carried out in the sewing machine M in the embodiment, the invention is not restricted thereto. For example, it is also possible to complete the work by storing the created sewing data in the external storage device 104, and to select and read the desirable integrated sewing data from the external storage device 104 at another time so as to carry out an embroidery sewing operation based on the integrated sewing data.

Furthermore, it is a matter of course that other specific detailed structures can also be changed.

While there has been described in connection with the exemplary embodiments of the present invention, it will be obvious to those skilled in the art that various changes and modification may be made therein without departing from the present invention. It is aimed, therefore, to cover in the appended claim all such changes and modifications as fall within the true spirit and scope of the present invention.

FIG. 2

(16) key matrix
(16*a*) start stop switch
(16*b*) backstitching switch
(16*c*) thread cutting switch
(16*d*) speed adjusting volume
(21) touch panel
(22) liquid crystal display portion
(104) external storage device
(14) X-axis motor
(15) Y-axis motor
(5) sewing machine motor

FIG. 11

(S101) Display a continuous pattern setting screen
(S102) Input and display continuous indicating points
(S103) Create and set a continuous line
(S104) Display and select an embroidery data list
(S105) Display a continuous embroidery pattern
(S106) Decision key pressed?
(S107) Cancel key pressed?
(S108) Create and store integrated embroidery data
(S109) Sewing start SW pressed?
(S110) Create needle location data for each of a plurality of embroideries
(S111) Sew a plurality of embroidery patterns in order of an arrangement
(S112) All embroidery sewing operations completed?

What is claimed is:

1. A sewing machine comprising:

a needle which moves in a vertical direction;

a cloth holding portion which holds a workpiece and moves in a direction orthogonal to the vertical direction;

a storage section which stores sewing data corresponding to a plurality of kinds of sewing patterns;

a display section having a display region corresponding to a sewing region of the cloth holding portion;

a continuous line setting section having a touch panel, wherein the continuous line setting section creates a line on the display region of the display section based on an input operation from the touch panel;

a selecting section which selects desirable sewing data from the sewing data stored in the storage section;

a pattern arranging section which automatically arranges a plurality of sewing patterns corresponding to the sewing data selected by the selecting section along the line created by the continuous line setting section and displays the plurality of sewing patterns on the display region;

a sewing data creating section which creates integrated sewing data on the plurality of sewing patterns arranged by the pattern arranging section;

a cloth holding portion moving section which moves the cloth holding portion in order to form the plurality of sewing patterns on the workpiece held by the cloth holding portion based on the integrated sewing data; and a change rate setting section which sets a change rate of sizes of the plurality of sewing patterns arranged along the line, wherein the pattern arranging section arranges the plurality of sewing patterns along the line such that the sizes of the plurality of sewing patterns are enlarged or reduced stepwise in accordance with the change rate set by the change rate setting section.

2. The sewing machine according to claim 1, wherein the pattern arranging section arranges the plurality of sewing patterns at regular intervals along the line.

3. The sewing machine according to claim 1, wherein the pattern arranging section arranges the plurality of sewing patterns along the line such that predetermined stitching ranges of the adjacent sewing patterns come in contact with each other.

4. The sewing machine according to claim 1, wherein the pattern arranging section arranges the plurality of sewing patterns at regular intervals along the line.

5. The sewing machine according to claim 1, wherein the pattern arranging section arranges the plurality of sewing patterns along the line such that predetermined stitching ranges of the adjacent sewing patterns come in contact with each other.

6. The sewing machine according to claim 1, wherein the continuous line setting section creates the line based on coordinate data of at least two points that are input from the touch panel.

7. A sewing machine, of the type having a sewing region work zone, comprising:

a storage section which stores sewing data corresponding to a plurality of kinds of sewing patterns;

a display device, the display device including a display region corresponding to the sewing region;

a continuous line setting section, wherein the continuous line setting section creates a line on the display region based on an operator input;

a selecting section which selects desirable sewing data from the sewing data stored in the storage section;

a pattern arranging section which automatically arranges a plurality of sewing patterns corresponding to the sewing data selected by the selecting section along the line created by the continuous line setting section, and wherein the plurality of sewing patterns are displayed on the display region;

a sewing data creating section which creates integrated sewing data on the plurality of sewing patterns arranged by the pattern arranging section; and a change rate setting section which sets a change rate of sizes of the plurality of sewing patterns arranged along the line in response to operator input, wherein the pattern arranging section arranges the plurality of sewing patterns along the line such that the sizes of the plurality of sewing patterns are enlarged or reduced stepwise in accordance with the change rate set by the change rate setting section.

* * * * *